United States Patent [19]

Fosness et al.

[11] 3,974,673

[45] Aug. 17, 1976

[54] TITANIUM PARTS MANUFACTURING

[75] Inventors: John P. Fosness; Louis Odor, both of Columbus, Ohio

[73] Assignee: Rockwell International Corporation, Pittsburgh, Pa.

[22] Filed: Apr. 7, 1975

[21] Appl. No.: 566,007

[52] U.S. Cl. ..... 72/38; 29/DIG. 45; 72/56; 72/342; 72/364; 72/700

[51] Int. Cl.[2] ..... B21D 26/02; B21J 5/04; B21J 1/06; B21D 37/16

[58] Field of Search ..... 29/DIG. 25, DIG. 45; 72/38, 56, 57, 60, 342, 364, 700; 148/11.5 F; 219/149, 150 R, 152, 154

[56] References Cited

UNITED STATES PATENTS

| | | | |
|---|---|---|---|
| 3,373,585 | 3/1968 | Reynolds | 72/57 |
| 3,529,457 | 9/1970 | Butler et al. | 72/56 |
| 3,595,060 | 7/1971 | Hundy | 72/364 |
| 3,920,175 | 11/1975 | Hamilton et al. | 228/173 |

FOREIGN PATENTS OR APPLICATIONS

| | | | |
|---|---|---|---|
| 47-8130 | 8/1972 | Japan | 72/56 |
| 1,231,428 | 5/1971 | United Kingdom | 72/342 |

OTHER PUBLICATIONS

"Pressworking," Mfg. Engineering & Management, Oct. 1971, p. 9, Hot Dimpling Thin Titanium Sheets.

*Primary Examiner*—C.W. Lanham
*Assistant Examiner*—E. M. Combs

[57] ABSTRACT

Apparatus and related process steps are disclosed for manufacturing titanium alloy sheet metal parts over a die form using radiant heating, particular mechanical motions, and differential fluid pressures in specific sequences of operations. The resulting parts have configurations with substantial depths and are produced both at accelerated rates and with reduced alloy contamination in comparison to known titanium sheet metal forming practices.

5 Claims, 9 Drawing Figures

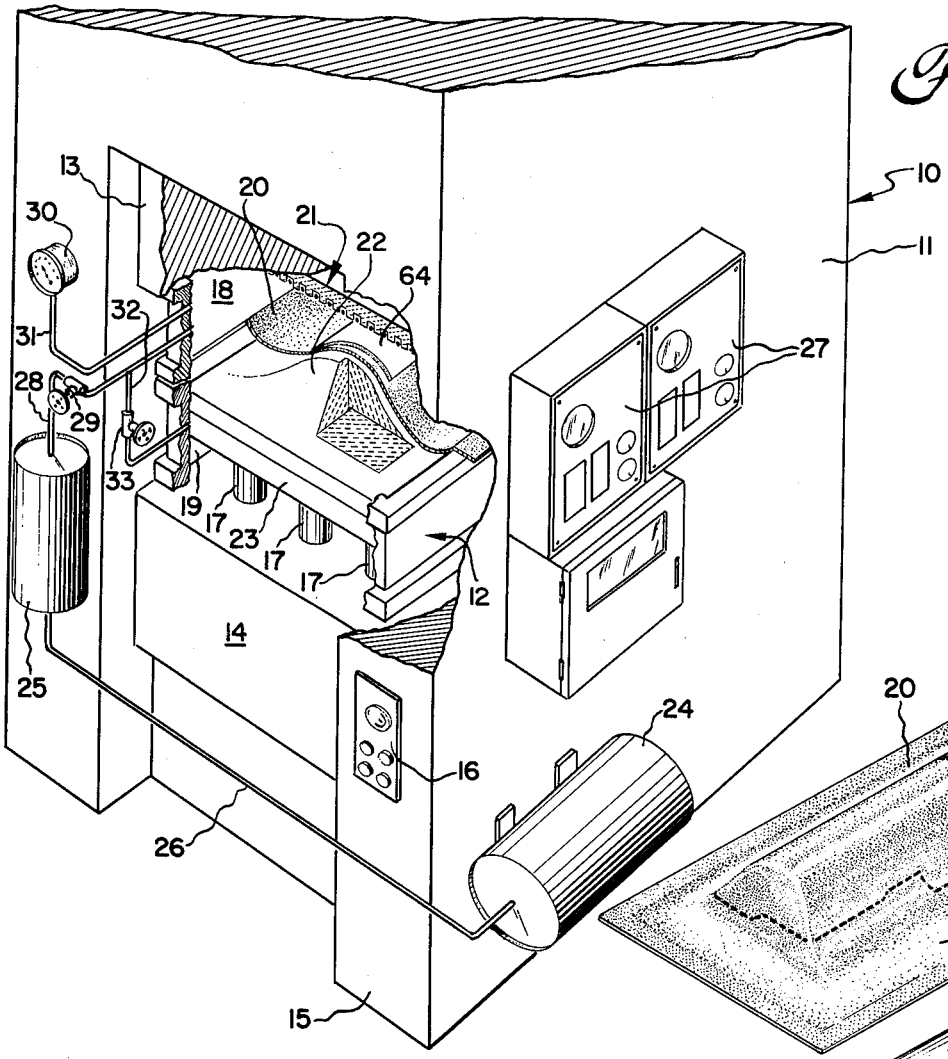
Fig. 1
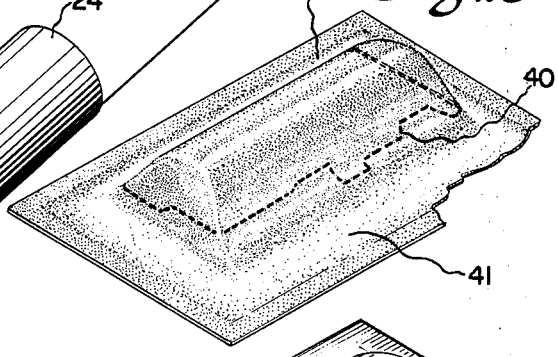
Fig. 2
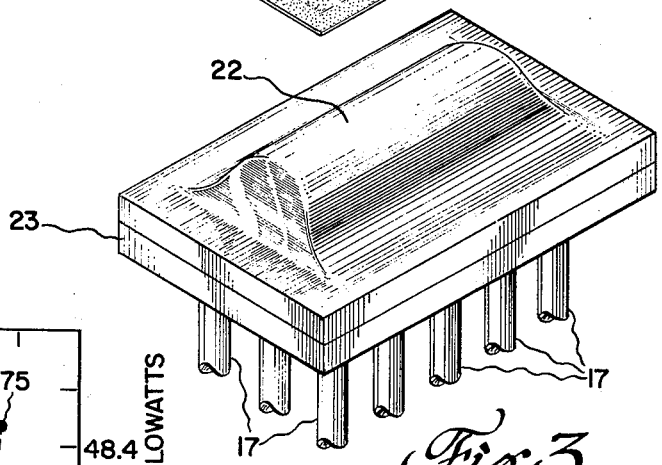
Fig. 3
Fig. 9
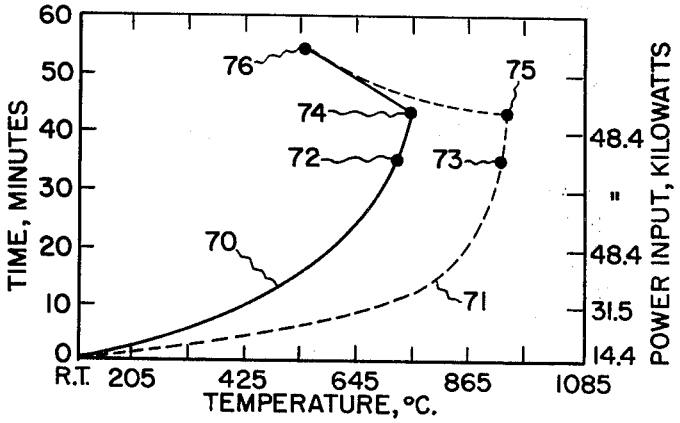

TITANIUM PARTS MANUFACTURING

SUMMARY OF THE INVENTION

A novel hot-forming chamber is installed in a conventional press and arranged to clamp a titanium alloy sheet immediately over a die having a surface configuration corresponding to the configuration of the desired part. Argon gas is provided at relatively low pressure in the hot-form chamber upper portion and selected portions of the clamped sheet are radiantly heated until the sheet is at a temperature of approximately 700° C to 850° C using electrical resistance radiant heating apparatus installed within the hot-form chamber above the sheet metal part. In the case of deep-form configurations produced over a male die, when the partially-formed sheet metal part has been heated to the desired elevated temperature of approximately 700° C or greater the pad of the press on which the die is supported is actuated to elevate the die in a direction causing elongation of the clamped heated sheet material. In the case of parts formed from relatively thick titanium alloy sheet stock the initially formed part is further formed over the die by significantly increasing the pressure at the inert gas in the upper hot-form chamber portion. In all cases the partially formed part is further radiantly heated in the clamped condition to a temperature not exceeding approximately 950° C to essentially complete the formation of the desired configuration. On completion of the forming sequence further radiant heating of the sheet metal ceases and the part is allowed to cool at a somewhat reduced internal pressure to about 540° C. Next the hot-form chamber is completely depressurized, the die if elevated is returned to its original position, the chamber interior opened to atmospheric conditions, and the completed titanium sheet metal part removed for subsequent conventional manufacturing processing.

DESCRIPTION OF THE DRAWINGS

FIG. 1 is a perspective view of a preferred embodiment of combined press and hot-form chamber apparatus employed in the practice of this invention;

FIG. 2 is a perspective view of a representative titanium alloy sheet metal part manufactured by the practice of this invention;

FIG. 3 is a perspective view of a ceramic die and support plate utilized in the apparatus of FIG. 1 to produce the titanium alloy sheet metal part of FIG. 2;

FIG. 9 graphically illustrates a typical time-temperature history utilized with the apparatus of FIG. 1 in the course of practicing the instant invention.

DETAILED DESCRIPTION

Figure 4:
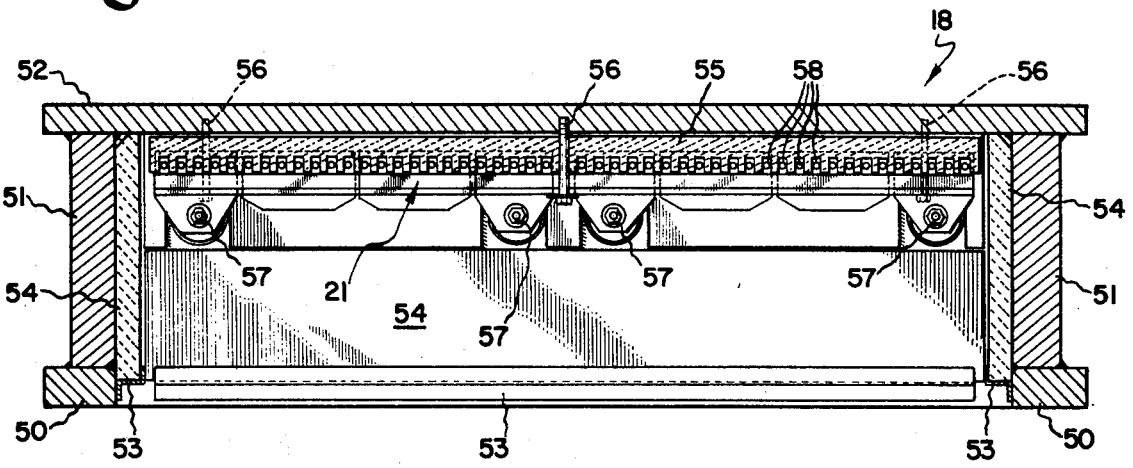
FIG. 4 is a section taken through the high pressure portion of the hot-form chamber included in the apparatus arrangement of FIG. 1.

FIG. 1 generally illustrates apparatus 10 in an embodiment preferred for practicing the herein claimed invention. Apparatus 10 is basically comprised of press 11 of conventional construction such as a double acting hydraulic press and a novel partially pressurized hot-form chamber assembly installed in such press intermediate the relatively movable press ram head 13 and press bolster 14. Bolster 14 is normally fixed relative to press frame 15 and upward/downward movement of ram head 13 relative to press bolster 14 is regulated by conventional press controls 16 that cooperate with the press hydraulic system (not shown). In addition, hydraulic press 11 is also preferably provided with a hydraulically-actuated pad (not shown) that is movable relative to press frame 15 and press ram head 13 and that basically is located at the interior of bolster 14. Such pad is controlled in its upward/downward movement by hydraulic controls 16 to effect corresponding movement of pins 17 supported by the press pad.

Hot-form chamber assembly 12 is comprised of an upper portion 18 secured to press ram head 13 and a separable lower portion 19 secured to press bolster 12. The titanium alloy sheet material formed by the practice of this invention is designated 20 in FIG. 1 and is clamped between hot-form chamber assembly portions 18 and 19, along with a suitable seal, by the force resulting from downward movement of press ram head 13 relative to press frame 15. Press clamping forces to as much as 360 metric tons have been utilized for titanium alloy sheets having approximately an 80 centimeter by 100 centimeter clamping perimeter and in some instances even greater press clamping pressures may be desirable. Details regarding the construction of upper hot-form chamber portion 18 and its included radiant heater 21 are provided in that portion of the description pertaining to FIG. 4. The lower hot-form chamber portion 19 secured to press bolster 14 contains a preferred ceramic die assembly 22 supported by plate 23 resting on ejection pins 17.

Equipment 10 further includes a supply of pressurized argon that is stored in tank 24 and flowed to electrical resistance gas heater 25 through gas line 26. Gas line 28 is connected to argon heater 25 and cooperates with the interior of hot-form chamber upper portion 18 to complete the flow path for pressurized argon gas from gas supply 24. A valve 29 is provided in line 28 to control pressurized gas flow. In addition, a pressure gauge 30 mounted on gas line 31 is provided for sensing the gas pressure within upper hot-form chamber portion 18. An additional gas line 32 with an included flow control valve 33 is provided for regulating the flow of pressurized argon from the interior of upper hot-form chamber portion 18 to the interior of lower hot-form chamber portion 19 when sheet material 20 is properly clamped in place by movement of ram head 13. It should be noted that elevated pressure conditions are not maintained in lower hot-form chamber portion 19. Conventional electrical voltage/current controls 27 are provided in apparatus 10 for regulating the electrical energy supply (not shown) operably connected to radiant heater 21.

FIG. 2 illustrates a representative configuration of the type of titanium alloy sheet metal part that can be formed from flat sheet stock by practice of this invention. Such configurtion is intended to illustrate the degree of forming that is obtained and is significant from the standpoint of manufacturing titanium alloy sheet metal parts of the type used extensively in high performance aircraft for structural and other functional purposes. Normally the FIG. 2 final formed shape 20 is later cut along dotted trim line 40 to produce the desired end configuration by the removal of the unneeded peripheral material designated 41. For instance the invention has been utilized to form parts from 3.15 millimeter thick 6Al-2Sn-4Zr-2Mo titanium alloy sheet stock to configuration similar to that shown in FIG. 2 with approximately a 15 centimeter depth and a configuration plan area of approximately 20 centimeters by 60 centimeters. The size of the clamped sheet from which the part was formed was approximately 105 centimeters by 90 centimeters. The present invention, it should be noted, also has been used in the forming of component parts from such alloys as 6Al-4V titanium and 8 Mn titanium. It should also be emphasized that some of the outstanding advantages of the instant invention as related to representative part 20 of FIG. 2 include reduced alloy contamination, elimination of excessive material thinning, and reduction of cycle time for forming to as little as approximately 1½ hours in some instances.

As shown in FIG. 3, ceramic die 22 has a configuration corresponding to the configuration to be provided in sheet metal part 20. One suitable composition for ceramic die 22 includes silica refractory particles and sodium silicate binder that subsequent to casting is dried and fired into a fused silica shape.

FIG. 4 is a sectional view taken through upper portion 18 of hot-form chamber 12 and illustrates that such upper portion is comprised of a steel support ring 50 around its periphery, a steel wall 51 joined to support 50 as by welding, and a cover plate 52 also is joined to wall 51 by welding. Such welding in-part assures that upper portion 18 of the hot-form chamber 12 is leakage-free and thereby in-part permits required elevated pressures generally to approximately 3 kilograms per square centimeter or greater to be achieved in the upper portion interior during use at elevated temperatures. Elongated and flanged clips 53 are secured to supporting ring 50 and function to support insulating refractory blocks 54 to minimize the transfer of heat from the interior of upper hot-form chamber portion 18 to ambient atmosphere during equipment operation. Similarly, roof insulating material 55 is supported interiorly of hot-form chamber portion 18 by studs 56 and serves to insulate the chamber interior from the cooling effect associated with cover plate 52 and press ram head 13. Connectors 57 function to electrically connect the individual resistance heating elements 58 in radiant heating array 21 to the system electrical energy supply (not shown) and voltage/current controls 17 through appropriate electrical energy conductors.

FIGS. 5 through 8 are provided in the drawings to illustrate the principal process stages through which a titanium alloy sheet is sequentially worked in accordance with the present invention utilizing equipment arrangement 10. The titanium alloy part formed therein in accordance with the present invention is identified at its different process stages by the reference numerals 60, 61, 62 and 63.

Figure 5:
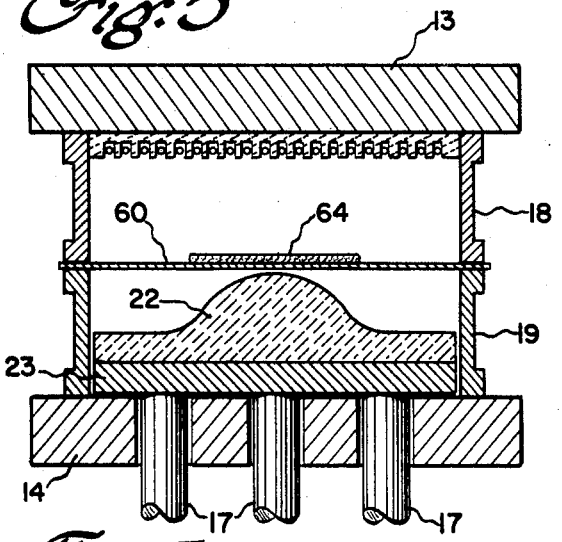
FIGS. 5 through 8 are schematic sectional views taken through the FIG. 1 apparatus hot-form chamber at different steps in the sequence of operations utilized in the practice of this invention.
Figure 6:
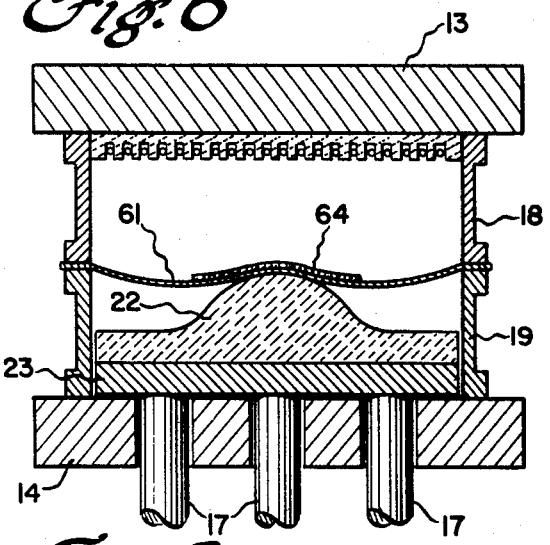

FIG. 5 illustrates the apparatus arrangement of FIG. 1 at the initiation of the practice of this invention for the first stage of processing. Flat sheet 60 of the selected titanium alloy with an appropriate metallic seal is securely clamped between upper and lower hot-form chamber portions 18 and 19 with an adequate force to properly restrain the periphery of sheet 60 during all subsequent stages of processing. The interior of chamber portion 18 is then purged with argon from gas supply 24 and on the completion of purging is maintained at an interior gauge pressure of from approximately 0.3 kilograms per square centimeter to 0.6 kilograms per square centimeter. A continuous gas flow from supply 24 to hot-form chamber portion 18 is preferred in order that argon gas from upper chamber portion 18 might be flowed through opened line 32 into lower chamber portion 19 to purge air therefrom and also to maintain the under side of sheet 60 in an inert atmosphere but essentially at ambient rather than elevated pressure since lower chamber portion 19 often cannot be sealed against leakage around ejection pins 17. In instances wherein die assembly 22 is fabricated of a ceramic material rather than a metal such as mild steel, a radiation shield 64 having a size and shape corresponding to the projected plan area of the part to be manufactured is placed on the upper surface of sheet 60 in alignment with die 22 to be intermediate such upper surface and radiant heater array 21. One suitable material for shield 64 is a paper formed from alumina fibers and silica fibers. The illustrated radiation shield, however, is not necessary in the practice of this invention if the die 22 is fabricated from a metal capable of conducting heat at a substantial rate. Using selected levels of power input achieved by operation of controls 27, electrical energy is flowed into the electrical resistance elements 58 of radiant heater array 21, until the temperature of sheet 60 is gradually raised to a temperature of about 700° C to 850° C. See the power schedule and time-temperature history set forth in FIG. 9 by way of example. When selectively shielded sheet 60 reaches the desired 700° C – 850° C upper limit as measured by suitably placed upper surface and under surface thermocouple devices (not shown) such material attains the representative condition shown in FIG. 6.

Figure 7:
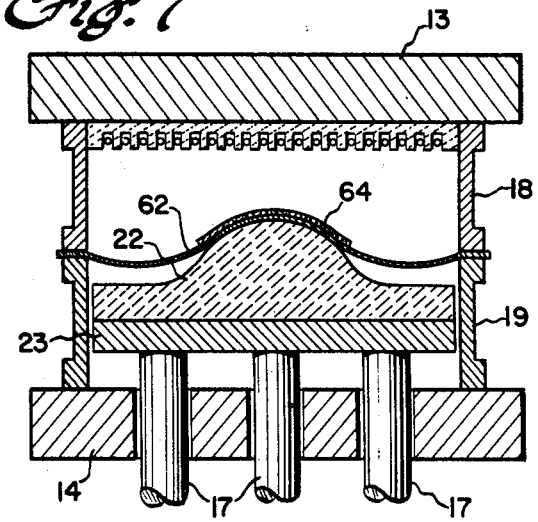
Figure 8:
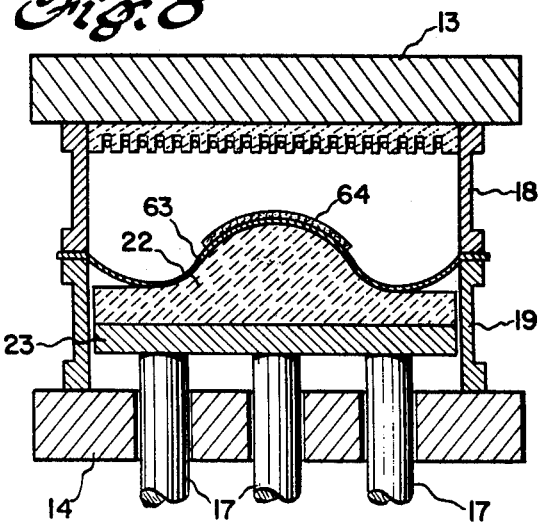

The next stage of processing accomplished with apparatus 10 is illustrated in FIG. 7 and basically involves, in the case of titanium alloy parts having a comparatively deep exterior configuration, the upward movement of die 22 to the upper limit established for ejection pins 17 to primarily further elongate metal in sheet 62 located in those regions surrounding trim line 40. The interior of upper hot-form chamber portion 18 is preferably maintained at the initial gauge pressure of 0.3 to 0.6 kilograms per square centimeter. Following the movement of die 22 to its FIG. 7 position, the argon gas pressure at the interior or upper hot-form chamber portion 18 is increased significantly to a level of approximately 3 kilograms per square centimeter or greater and the elements of radiant heater array 21 are further elevated in temperature, usually with an increase in power input, for a sufficient time to raise the temperature of partially formed sheet 62 to a temperature approaching and not significantly above approximately 950° C at its upper surface. During such stage of processing sheet 62 of FIG. 7 gradually assumes the configuration illustrated as sheet 63 in FIG. 8.

The last stage of processing important for the practice of this invention involves cooling of sheet 63 at an accelerated rate to a preferred temperature of approximately 550° C. Such usually is accomplished with a concurrent reduction of pressure within the interior or upper hot-form chamber portion 18 to a level of approximately 2.5 kilograms per square centimeter. When the formed sheet has been cooled to the preferred 550° C temperature, the interior of upper chamber portion 18 is depressurized to ambient pressure and die 22 is returned to its original position by downward movement of press pad ejection pins 17. The press ram head 13 and attached hot-form chamber upper portion 18 are moved upward relatively to press frame 15 by the manipulation of controls 17 to thereby permit withdrawal of the completed part from the separated upper and lower chamber portions for further manufacturing processing.

Other modifications may be incorported into apparatus 10 for the forming of other configurations in titanium alloy sheet material. In those applications where the amount of depth imparted to the finished part is relatively shallow it is not necessary to impart separate mechanical motion to die form 22 provided the die is positioned immediately under the flat sheet as in FIG. 5 and provided the radiation shield required in the case of ceramic die forms is positioned on the sheet in alignment with the die portions having the configuration of the desired parts.

Also the practice of the herein disclosed and claimed invention is useful in forming titanium alloy parts using a female die configuration. In such cases it is preferred that the female die be made of a metal such as mild steel rather than of ceramic material. It is not desirable or necessary in the case of female-type dies to move the die relative to the press bolster 14 provided the upper surface of the die is initially positioned immediately below the flat titanium alloy sheet 60.

FIG. 9 is provided in the drawings to illustrate a typical time/temperature history for the manufacture of titanium alloy parts in accordance with the practice of this invention. The part manufactured had a configuration similar in size and depth to that shown in and desired in connection with FIG. 2 and involved in 6Al-4V titanium alloy sheet with an initial thickness of approximately 1.2 millimeters. As in other cases involving the manufacturing of parts from relatively thin sheet material, the argon gas pressure in upper hot-form chamber portion 18 was maintained at approximately 0.9 kilograms per square centimeter throughout the entire cycle. The FIG. 9 curve designated 70 illustrates the temperatures measured at the underside of the 1.2 millimeter sheet during processing and the curve designated 71 indicates the temperature measured at the upper surface of such sheet. Points 72 and 73 on curves 70, 71 indicate the point in the cycle wherein the die assembly was elevated a total of approximately 7.5 centimeters to elongate peripheral metal in the alloy sheet. Power input to resistance heating elements 58 in array 21 was cut off at the points designated 74, 75. Cooling from the cycle maximum temperatures was completed to the preferred lower temperature of 550° C at point 76 on curve 70 and thereafter hot-form chamber 12 was depressurized and then opened for the removal of the formed part. Total operative time in the cycle was less than one hour.

One of the significant advantages associated with the invention disclosed and claimed herein is the reduced level of contamination that is achieved in connection with completed titanium alloy sheet metal parts. Oxidation at each side of a completed part has been consistently held to depth levels in the range of 10 microns to 100 microns and such oxidation as does occur may readily be removed by subsequent conventional descaling and etch-cleaning step sequences using commonly employed caustic soda and nitric/hydroflouric acid solutions and rinses. Hydrogen pickup in completed titanium alloy parts to levels below approximately 150 parts per million can also be achieved by the practice of this invention, particularly if care is taken to avoid the use of organic-containing coatings on the sheet material surface directly in line with radiant heater array 21. Lubrication of the to-be-formed titanium alloy sheet at the adjacent die assembly 22 with a conventional coating such as molybdenum graphite generally is acceptable and desirable, however.

A significant reduction of excessive thinning in completed titanium alloy sheet metal parts is also obtained in connection with the practice of this invention. Specifically, thickness control to within ± 25 percent of the completed part nominal thickness is readily achieved and in many instances part thickness control to within ± 10 percent of nominal thickness is approached. By way of example, an essentially J-shaped ducting elbow longitudinal half having an over-all height of approximately 65 centimeters, an over-all width of approximately 35 centimeters, and a cross-sectional diameter of approximtely 15 centimeters was formed to a maximum radius-like depth of 15 centimeters from and interiorly of a flat sheet of 6Al-4V titanium alloy of nominal 2 millimeters ± 10 percent thickness and 85 centimeters by 100 centimeters over-all size. Thicknesses in that portion of the completed duct half adjacent the first portions of the die assembly contacted by the sheet during forming were controlled to within a range of 1.80 millimeters to 1.90 millimeters (after cleaning) and the near-vertical wall areas of the part were controlled to a thickness in the range of approximately 1.25 millimeters to 1.50 millimeters. The to-be-removed sheet material around the periphery of the completed part three-dimensional configuration had a typical thickness in the range of approximately 0.75 millimeters to 1.00 millimeters.

It should be noted that radiant heater 21 is controlled thermostatically by voltage/current control means 27 as between upper and lower temperature limits in order to achieve the proper forming of titanium alloy sheet metal parts in accordance with this invention in an effective manner. Such thermostatic control is preferably developed in part in upper chamber portion 18 and curve 71 of FIG. 9 illustrates the typical maximum temperature achieved within titanium alloy sheet 60. The temperature differential that typically exists as between the temperature sensed by the thermocouple at the upper face of the clamped sheet and the atmosphere temperature generally is approximately 25° C to 50° C, and frequently the control upper limit temperature is set for approximately 958° C. The temperatures recorded in connection with curve 70 of FIG. 9 were developed in connection with lower limit thermocouple elements in contact with the under side of sheet 60 and such do not receive radiation by impingement directly from radiant heater 21. Also, the temperature sensed by the thermocouple elements at the under side of sheet 60 is influenced by the temperature condition of the cooling inert atmosphere gases being flowed from upper chamber portion 18, through lower chamber portion 19, and to ambient temperature. In numerous instances involving the manufacturing of titanium alloy sheet metal parts in accordance with the herein-claimed invention the maximum temperature difference developed with respect to curves 70 and 71 varies considerably but often is as much as approximately 80° C.

We claim:

1. In a method of manufacturing a titanium alloy sheet metal part having a three-dimensional form portion within an essentially flat periphery portion from a substantially flat sheet of titanium alloy, the steps of:

a. Clamping said titanium alloy sheet continuously around its periphery between the clamping face of a pressurizable chamber containing an electrical resistance heater means offset from said pressurizable chamber clamping face and the clamping face of an opposed and aligned chamber containing a die member with a ceramic forming surface corresponding in shape and size to said metal part three-dimensional form b. Directly radiantly heating said clamped sheet to a maximum temperature in the range of approximately 850° C to 950° C only with respect to surface areas substantially outside the planform projection of said ceramic forming surface by said electrical resistance heater means and with an argon atmosphere in said pressurizable chamber at a first fluid pressure that is elevated with respect to ambient pressure and that is not less than approximately 0.3 kilograms per square centimeter and in said opposed and aligned chamber that is at a second fluid pressure that is substantially less than said first fluid pressure;

c. Maintaining said clamped sheet at temperatures within said maximum temperature range and said argon atmosphere at said fluid pressure until surface portions of said clamped sheet periphery conform to said die member ceramic forming surface;

d. Cooling said clamped sheet conformed surface portions to a temperature not substantially exceeding approximately 550° C; and e. Releasing said clamped sheet from its clamped condition between said chamber clamping faces after reducing said argon atmosphere fluid pressure to ambient pressure.

2. In a method of manufacturing a titanium alloy sheet metal part having a three-dimensional form portion within an essentially flat periphery portion from a substantially flat sheet of titanium alloy, the steps of:

a. Clamping said titanium alloy sheet continuously around its periphery between the clamping face of a pressurizable chamber containing an electrical resistance heater means offset from said pressurizable chamber clamping face and the clamping face of an opposed and aligned chamber containing a die member with a forming surface that corresponds in shape and size to said metal part three-dimensional form portion and that additionally is movable toward and away from said clamped sheet;

b. Directly radiantly heating said clamped sheet to a temperature in the range of approximately 700° C to 850° C by said electrical resistance heater means and with an argon atmosphere in said pressurizable chamber at a first fluid pressure that is elevated with respect to ambient pressure and that is not less than approximately 0.3 kilograms per square centimeter and in said opposed and aligned chamber that is at a second fluid pressure that is substantially less than said first fluid pressure;

c. Moving said die member forming surface in a direction toward said clamped titanium alloy sheet a sufficient distance to substantially thin portions of said clamped sheet outside the planform projection of said die member forming surface;

d. Directly radiantly heating said clamped sheet to a maximum temperature in the range of approximately 850° C to 950° C by said electrical resistance heater means;

e. Maintaining said clamped sheet at temperatures within said 850° C to 950° C maximum temperature range and said argon atmosphere at said fluid pressure until surface portions of said clamped sheet conform to said die member forming surface;

f. Cooling said clamped sheet conformed surface portions to a temperature not substantially exceeding approximately 550° C; and g. Releasing said clamped sheet from its clamped condition between said chamber clamping faces after reducing said argon atmosphere fluid pressure to ambient pressure.

3. The method of manufacture defined by claim 2 wherein said step of radiantly heating said clamped sheet involves increasing said argon atmosphere fluid pressure substantially above said fluid pressure of not less than 0.3 kilograms per square centimeter after said clamped sheet has attained a temperature in said range of approximately 700° C to 850° C and before said clamped sheet has attained its maximum temperature in said range of approximately 850° C to 950° C.

4. Apparatus for manufacturing a titanium alloy sheet metal part having a three-dimensional form portion located interiorly of an essentially flat perimeter portion from a substantially flat titanium alloy sheet comprising;

a. First chamber means having a clamped face that cooperates with the perimeter of said titanium alloy sheet and an interior that is selectively pressurizable to a fluid pressure that is elevated relative to ambient pressure when said first chamber means clamping face is engaged with said titanium alloy sheet in clamping relation;

b. Second chamber means having an interior and a clamping face that cooperates with said titanium alloy sheet perimeter, said second chamber means clamping face being aligned with said first chamber means clamping face when said second chamber means clamping face is engaged with said titanium alloy sheet perimeter in clamping relation;

c. Electrical resistance radiant heater means positioned within said first chamber means interior in offset relation to said first chamber means clamping face;

d. Die means having a forming surface that corresponds in shape and size to said sheet metal part three-dimensional form portion and that is positioned within said second chamber means interior in aligned relation to said radiant heater means;

e. Hydraulic press means engaging said first and second chamber means in clamping relation with the periphery of said titanium alloy sheet;

f. A supply of pressurized inert gas cooperatively connected to said first chamber means interior and selectively flowed to said first chamber means interior to pressurize said first chamber means interior to said elevated fluid pressure; and g. Shielding means preventing direct impingement of radiant energy from said heater means on said clamped sheet, said shielding means having a planform substantially corresponding in shape and size to the planform of said sheet metal part three-dimensional form portion and being positioned in said first chamber means intermediate said clamped sheet and said resistance heater means and in aligned relation to the projection of said die means forming surface planform on said clamped sheet.

5. The apparatus defined by claim 4, wherein said die means forming surface is a fused ceramic surface.

* * * * *

UNITED STATES PATENT OFFICE

CERTIFICATE OF CORRECTION

PATENT NO. : 3,974,673

DATED : Aug. 17, 1976

INVENTOR(S) : John P. Fosness and Louis Odor

It is certified that error appears in the above-identified patent and that said Letters Patent are hereby corrected as shown below:

Column 7, line 9, after the word "form" add -- portion; -- .

Signed and Sealed this

Sixteenth Day of November 1976

[SEAL]

*Attest:*

RUTH C. MASON
*Attesting Officer*

C. MARSHALL DANN
*Commissioner of Patents and Trademarks*